US006155887A

United States Patent [19]

Cuff et al.

[11] Patent Number: 6,155,887

[45] Date of Patent: Dec. 5, 2000

[54] STACKABLE CONNECTOR SYSTEM AND CONTACT FOR USE THEREIN

[75] Inventors: Michael P. Cuff; Claude G. Folta, both of Georgetown, Tex.

[73] Assignee: Airborn, Inc., Georgetown, Tex.

[21] Appl. No.: 09/313,751

[22] Filed: May 27, 1999

[51] Int. Cl.[7] ..... H01R 13/42

[52] U.S. Cl. ..... 439/751; 439/84

[58] Field of Search ..... 439/84, 65, 751, 439/873, 943, 678, 682, 686, 689

[56] References Cited

U.S. PATENT DOCUMENTS

| | | | |
|---|---|---|---|
| 2,980,881 | 4/1961 | McKee | 439/682 |
| 3,663,931 | 5/1972 | Brown | 439/70 |
| 4,030,792 | 6/1977 | Fuerst | 439/65 |
| 4,206,964 | 6/1980 | Olsson | 439/873 |
| 4,464,009 | 8/1984 | Thaler | 439/873 |
| 4,802,868 | 2/1989 | Rolf et al. | 439/689 |
| 4,806,105 | 2/1989 | Muzslay | 439/74 |
| 5,139,446 | 8/1992 | Costello et al. | 439/943 |

FOREIGN PATENT DOCUMENTS 779946 7/1957 United Kingdom .

*Primary Examiner*—T. C. Patel
*Attorney, Agent, or Firm*—Jenkens & Gilchrist, A Professional Corporation

[57] ABSTRACT

Disclosed is a stackable contact system and a contact for use therein. The contact has a tuning fork socket and a cylindrical pin with a bowed compliant middle section for press fitting into a printed circuit board. Multiple contacts are mounted in two insulative housing parts having cavities, apertures and passages for holding the contacts in position. The contact systems may have a printed circuit board sandwiched between them, and multiple layer stacks may be formed.

4 Claims, 5 Drawing Sheets

STACKABLE CONNECTOR SYSTEM AND CONTACT FOR USE THEREIN

FIELD OF THE INVENTION

This invention relates to stackable electrical connector systems, and contacts for use in such systems.

BACKGROUND OF THE INVENTION

Stackable connector systems are needed in many situations in the design and construction of electronic equipment involving printed wiring boards or printed circuit boards. In this kind of construction, it is important that the system provide sound electrical connections which also have the mechanical properties necessary to provide a sound structure. It is also important to be able to connect many contacts together in a single operation.

SUMMARY OF THE INVENTION

In accordance with one aspect of the invention, a contact for use in a stackable connector system for printed wiring boards is provided. The contact has a female end formed in a tuning fork configuration. The contact also has a compliant middle section with opposed outwardly projecting integral spring elements for yieldingly engaging the wall of a hole in a printed circuit board. The female tuning fork end and the male cylindrical end of the contact are sized and proportioned to permit end-to-end mating of a plurality of contacts. It is preferred that the contact be equipped with shoulders positioned between the female tuning fork end and the compliant middle section for mounting engagement with corresponding mounting passage walls in a contact mounting piece.

In further accordance with the invention, a stackable connector is provided which is made up of a two-part connector housing. The first part is a first generally planar insulative sheet provided with a plurality of contact-accommodating cavities formed in one surface thereof and arranged in a selected pattern. The cavities are each sized and proportioned to accommodate the tuning fork end of a first contact within it. The sheets have a plurality of apertures on the opposite surface thereof arranged in the same selected pattern so that they can each admit the cylindrical end of a second contact to mate with the tuning fork end of the first contact positioned in a cavity. The second part of the connector is a second generally planar insulative sheet which has a plurality of shouldered passages therethrough arranged in the selected pattern and sized and proportioned to admit passage therethrough of the cylindrical end and compliant middle section of the first contact while engaging the shouldered portion of that contact. A plurality of conductive contacts are positioned in the cavities and shouldered passages when the first part and the second part are placed in juxtaposition with the cavities and passages aligned. Each contact has a tuning fork end, a shouldered portion, a compliant middle section, and a cylindrical end. It is further preferred that the shouldered passages of the second part of the connector are arranged in the second part with shoulders of adjacent passages oriented orthogonally to one another.

In accordance with a still further aspect of the invention, a connector and printed circuit board assembly is provided which includes a printed circuit board having plated-through holes therein arranged in a selected pattern. It also has a first connector constructed as just described having cavities and passages therein arranged in a selected pattern conforming to that of the printed circuit board. The first connector has the compliant middle sections of its contacts in engagement with the plated-through holes of the printed circuit board, and the cylindrical ends of its contacts projected out of the printed circuit board. A second connector having the structure just described is provided. It has cavities and passages therein arranged in a selected pattern conforming to that of the printed circuit board. The second connector has the cylindrical ends of the contacts of the first connector received in the tuning fork ends of its contacts.

DESCRIPTION OF PREFERRED EMBODIMENTS

Figure 1:
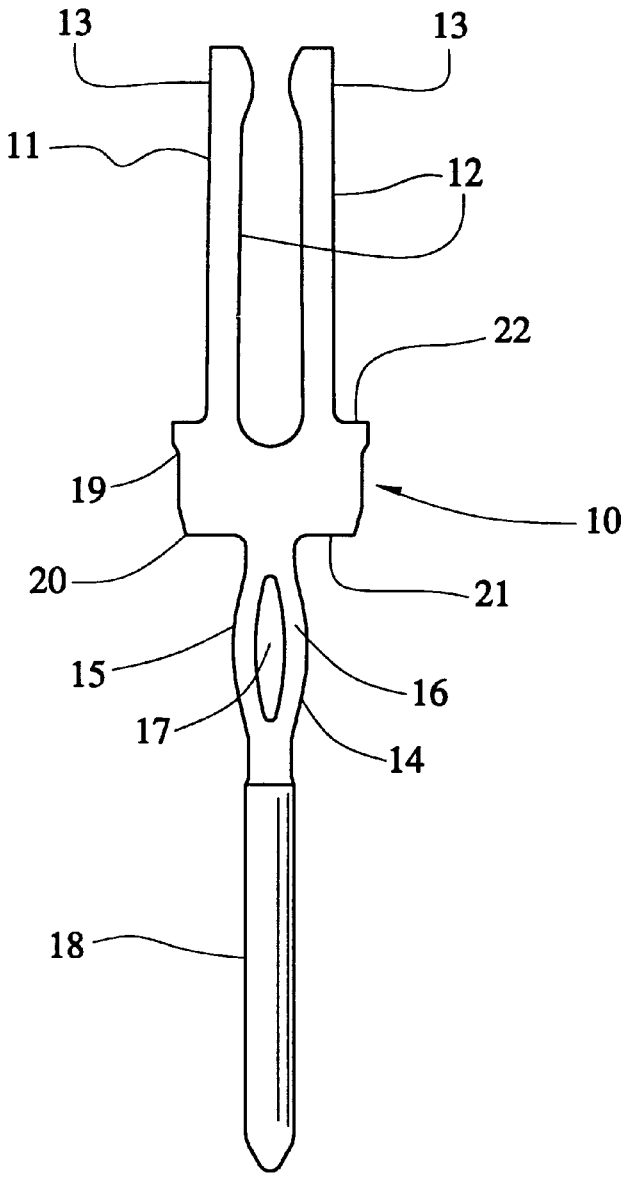
FIG. 1 is an elevational front view of a contact constructed in accordance with the invention for use in connector systems of the invention.
Figure 2:
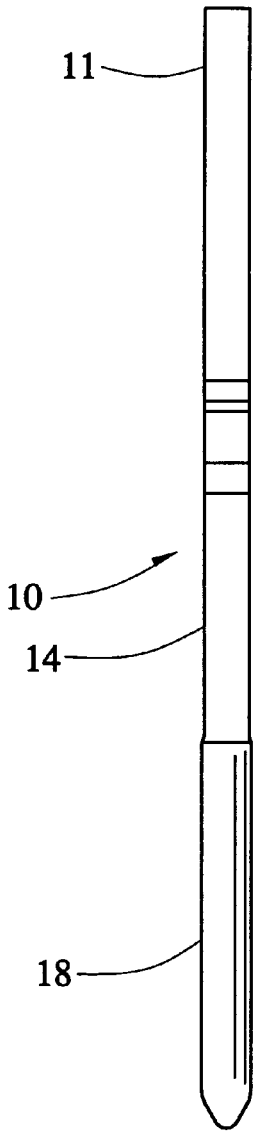
FIG. 2 is a side elevational view of the contact of FIG. 1.
Figure 3:
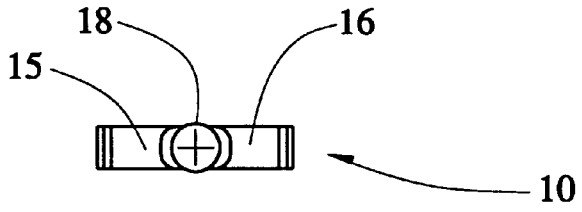
FIG. 3 is a bottom plan view of the contact of FIG. 1.

Attention is first directed to FIGS. 1, 2 and 3, which show a contact 10 of the invention, formed of conductive material which may be plated with gold or another conductivity-enhancing material on the surfaces which make contact with other contacts.

One end of contact 10 is formed into a tuning-fork type socket 11, which comprises two parallel spaced upright members or tines 12, which give the socket a bifurcated appearance somewhat like a tuning fork. The tines 12 establish good contact with a suitably sized pin when it is inserted between the tines 11 from above.

In the middle section 14 of contact 10, the structure is arranged to be compliant with a plated-through hole in a printed circuit board, as will appear in the discussion below. The compliant middle section 14 is formed with opposed outwardly projecting integral spring elements 15 and 16. In their unstressed condition, the spring elements are spread apart sufficiently to have a greater overall width than the diameter of a plated-through hole in a printed circuit board with which they are designed to be used. Also, in their unstressed condition, the spring elements define an opening 17 between them which is generally lens shaped in profile. When a contact is pressed through a plated-through hole having a smaller diameter than the unstressed width of the spring elements, they are compressed inwardly to partly or entirely close opening 17 while at the same time establishing good mechanical and electrical metal-to-metal contact between the wall of the hole and the surfaces of the spring elements. Because this good contact results from the action of pressing the contact into the hole, the contact may be referred to as press-fitted. Also, the good fit between the contact and the wall of the hole makes it apt to characterize the contact as compliant.

The bottom end of contact 10, as FIG. 1 is drawn, is a male cylindrical end 18. It is sized and proportioned so that it can mate with the female tuning fork end of a contact 11 positioned below it, and form good electrical and mechanical contact with it.

Between the tuning fork contact section 11 and the compliant middle section 14, the contact 10 is provided with a shouldered section 19 for fitting against corresponding shoulders in insulative portions of the connector housing, as will appear more fully hereinbelow. The shouldered section includes a downwardly facing pair of narrow shoulders 20, a pair of intermediate downwardly facing shoulders 21, and a pair of upwardly facing shoulders 22. When a contact is inserted into the connector housing parts, the shoulders, together with the corresponding shoulders or other surfaces of the part or parts, position the contact and support it from the bottom and top.

Figure 4:
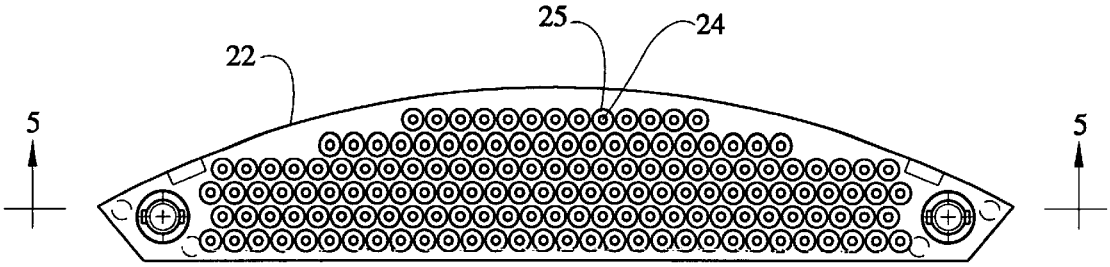
FIG. 4 is a top plan view of the upper part of a stackable connector system constructed in accordance with the invention, shown on a smaller scale than FIG. 1.
Figure 5:
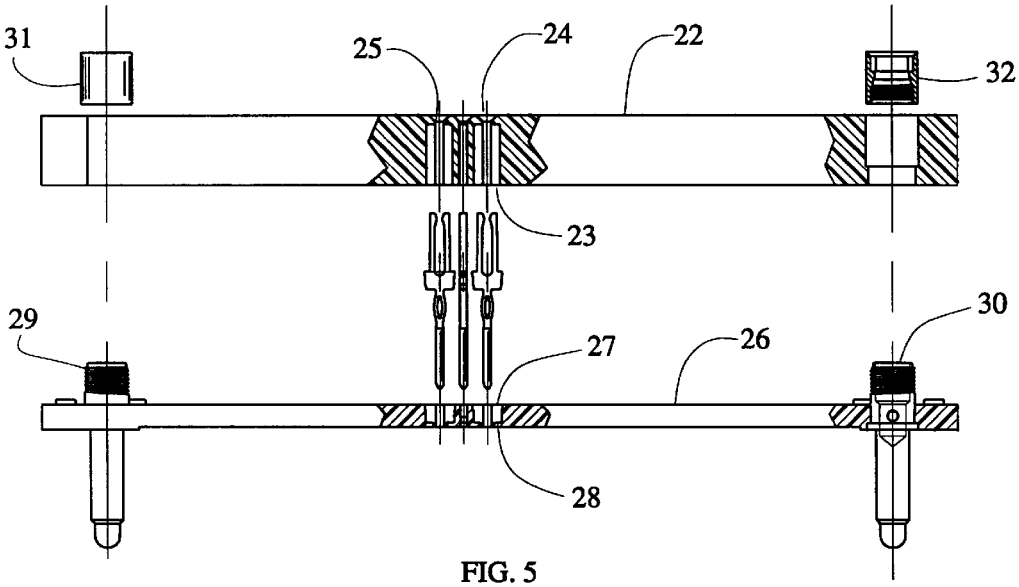
FIG. 5 is an exploded side elevational view, partly in section, of a connector system constructed in accordance with the invention, showing its upper part, lower part, contacts and fasteners, on the same scale as FIG. 4, the section in part being taken on the line 5—5 of FIG. 4, and further in part being taken on the line 5—5 of FIG. 6.
Figure 6:
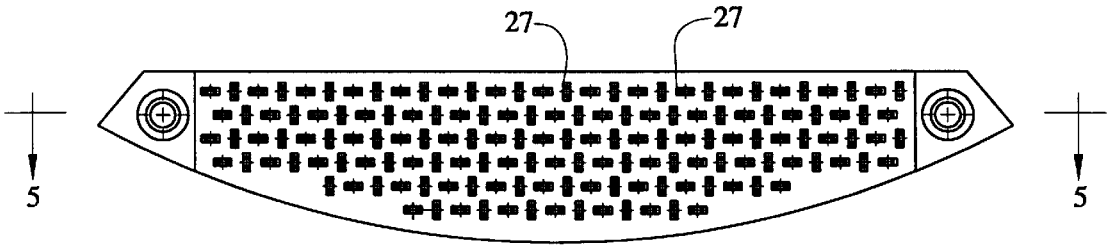
FIG. 6 is a bottom plan view of the lower part of a stackable connector system constructed in accordance with the invention shown on the same scale as FIGS. 4 and 5.

Attention is now directed to FIGS. 4, 5 and 6, which when taken together show all of the parts of a stackable connector system constructed in accordance with the invention. In FIGS. 4 and 5, the upper part 22 of the connector system is formed of insulative material. It has a plurality of cavities 23 formed therein which are sized and proportioned to accommodate the tuning fork end of a contact. The cavities 23 extend less than all the way through the thickness of the part 22. Each cavity 23 is accompanied by an aperture 24 by which a passage to the top side of part 22 is provided. The apertures 24 are preferably chamfered as at 25 to assist in centering the cylindrical leg 18 of a contact in a connector system applied above the system shown in FIGS. 4 through 6 in the course of assembly.

The second part of the connector or connector system is another sheet of material 26. It is provided with passages 27 which are aligned with the cavities 23 of the first part. Passages 27 are provided with shoulders 28 which correspond to shoulders 21 on a contact 10 (see FIG. 1).

As can be seen from FIG. 6, adjacent passages 27 are aligned orthogonally to adjacent passages, which aids in obtaining compactness in the arrangement of the contacts. As can be seen in FIG. 6, the passages 27, when viewed in plan, are generally rectangular.

In order to assemble the two parts 22 and 26 of the assembly together with the contacts positioned in the cavities 23 and passages 27, connector means in the form of guide posts 29 and 30 and spanner nuts 31 and 32 are provided.

Figure 7:
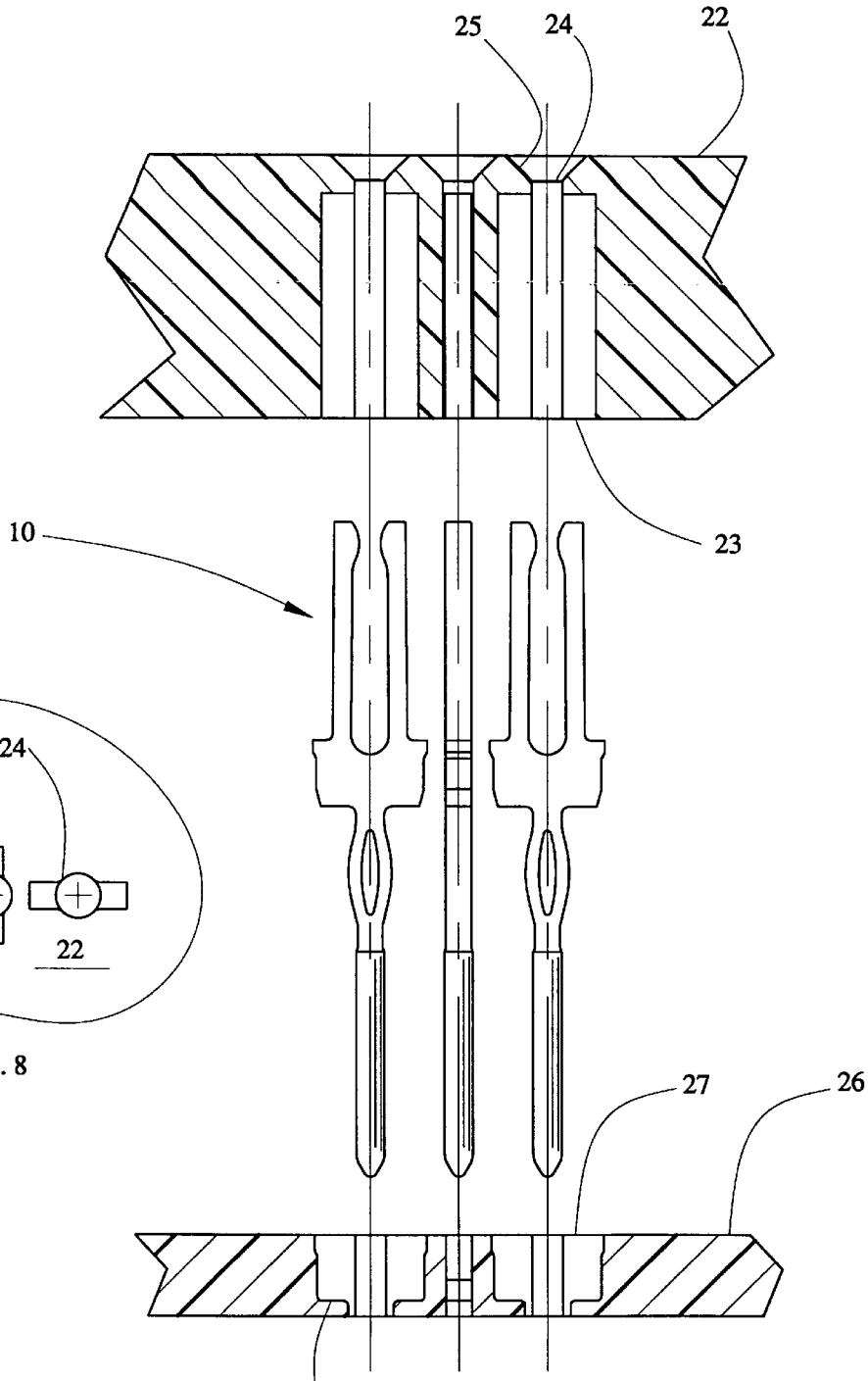
FIG. 7 is an exploded fragmentary side elevational view, partly in section, of a connector system constructed in accordance with the invention, similar to FIG. 5, but on an enlarged scale.

FIG. 7 is very similar to FIG. 5, discussed above, but is on an enlarged scale. The reference characters used on the two figures are the same.

Figure 8:
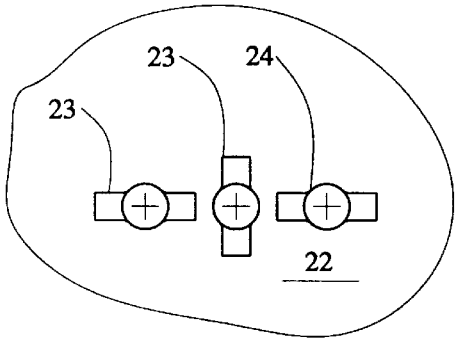
FIG. 8 is a fragmentary bottom plan view of the upper part of the stackable connector system of FIG. 7, on the same scale as FIG. 7.

FIG. 8 is a fragmentary bottom plan view of the upper part 22 of a stackable connector system, drawn to the same scale as FIG. 7, and shows that the cavities 23 in the upper part 22 are generally rectangular in plan, similarly to passages 27 in the bottom part of the assembly (see FIG. 6). Also, the cavities 23 are arranged with adjacent cavities positioned orthogonally to one another in order to achieve greater compactness of the system.

Figure 9:
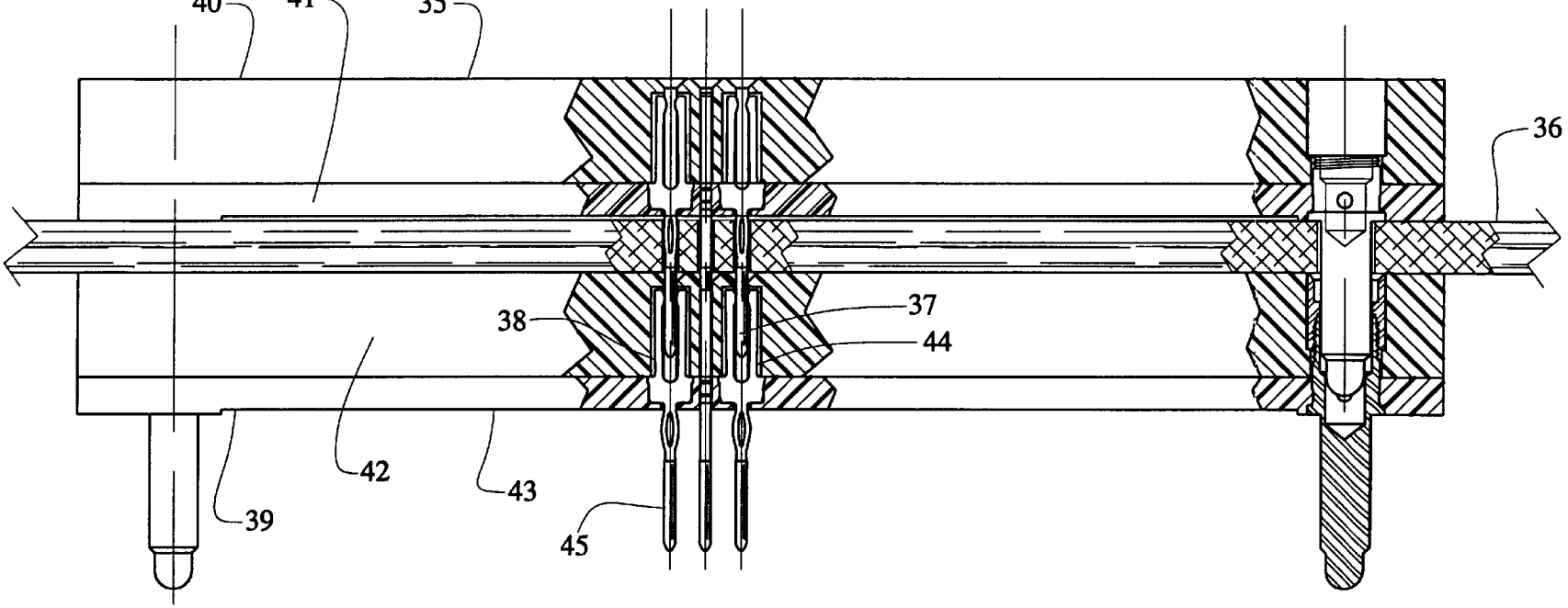
FIG. 9 is a side elevational view, partly in section, of two stackable connector systems of the invention assembled together with a printed wiring board sandwiched between them.
Figure 10:
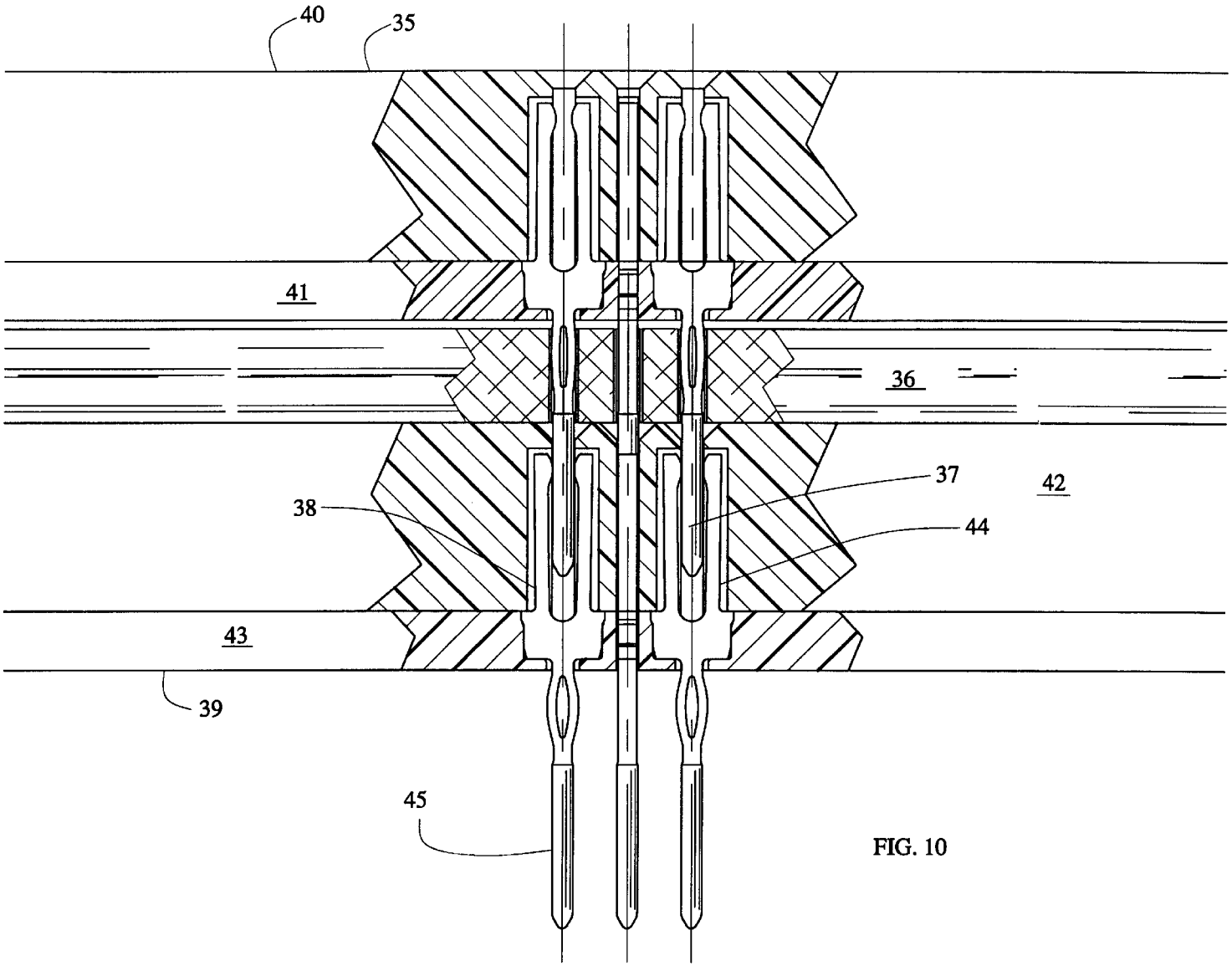
FIG. 10 is a side elevational view partly in section, similar to FIG. 9, but on an enlarged scale.

FIGS. 9 and 10 are similar, but FIG. 10 is on an enlarged scale. They show two stackable connector systems of the invention united with one printed circuit board to form an assembly to which still other circuit boards and stackable connector systems may be united, if desired.

In FIGS. 9 and 10, there is a top connector system 35 whose contacts are press fitted into a printed circuit board 36 and whose cylindrical contact ends 37 are fitted into tuning fork sockets 38 of contacts mounted in a lower stackable connector system 39. The upper stackable contact system 35 has a top part 40 and a bottom part 41, as has been explained above, and, similarly, the bottom connector system has a top part 42 and a bottom part 43. The cylindrical pins of the contacts 44 of the bottom connector system are designated 45 and protrude downwardly for insertion through another printed circuit board and engagement with the tuning fork contacts of still another stackable connector system, if desired.

What is claimed is:

1. A contact for use in a stackable connector system for printed circuit boards comprising:

said contact having a female end formed in a tuning fork configuration;

said contact having a male end of cylindrical configuration; and said contact having a compliant middle section with opposed outwardly projecting integral spring elements for yieldingly engaging the wall of a hole in a printed circuit board, said spring elements, in their unstressed condition, defining an opening between them which is generally lens shaped in profile; said integral spring elements further having rounded outer surfaces for establishing good electrical and mechanical contact with the surface of a plated through hole in said printed circuit board when press fitted into said hole;

the female tuning fork end and the male cylindrical end being sized and proportioned to permit mating of a female contact at the male end and a male contact at the female end so that a plurality of contacts may be connected together, and said contact further comprising generally planar shoulders positioned between said female tuning fork end and said compliant middle section for mounting engagement with corresponding mounting passage walls in a contact mounting piece.

2. A stackable connector for connecting conductive contacts to plated through holes in a printed circuit board comprising a two-part connector housing having a first part and a second part, the first part being a first generally planar insulative sheet provided with a plurality of contact-accommodating cavities formed in one surface thereof and arranged in a selected pattern, said contacts being of the kind having a tuning fork end, a compliant middle section, a generally planar shouldered portion and a cylindrical end, said cavities each being sized and proportioned to accommodate the tuning fork end of a first contact within it, said sheet having a plurality of apertures on the opposite surface thereof arranged in said selected pattern, each aperture being positioned to admit the cylindrical end of a second contact to mate with the tuning fork end of said first contact positioned in a cavity;

the second part being a second generally planar insulative sheet having a plurality of shouldered passages therethrough arranged in said selected pattern sized and proportioned to admit passage therethrough of the cylindrical end and compliant middle section of said first contact while engaging the generally planar shouldered portion of said first contact; and a plurality of conductive contacts positioned in said cavities and shouldered passages when said first part and said second part are placed in juxtaposition with the cavities and passages aligned, each contact having a tuning fork end, a generally planar shouldered portion, a compliant middle section, with opposed outwardly projecting integral spring elements for yieldingly engaging the wall of a hole in a printed circuit board, said spring elements, in their unstressed condition, defining an opening between them which is generally lens shaped in profile; said integral spring elements further having rounded outer surfaces for establishing good electrical and mechanical contact with the surface of a plated through hole in said printed circuit board when press fitted into said hole, and a cylindrical end sized and proportioned to mate with a turning fork end of another contact.

3. A connector in accordance with claim 2 in which said shouldered passages are arranged in said second part with all shoulders of immediately adjacent passages in each row of passages oriented orthogonally to one another.

4. A connector and printed circuit board assembly comprising:

a printed circuit board having plated-through holes therein arranged in a selected pattern;

a first connector of claim 2 having cavities and passages therein arranged in a selected pattern conforming to that of said printed circuit board, said first connector having the compliant middle sections of its contacts engaging said plated-through holes of said printed circuit board, and the cylindrical ends of its contacts projected out of said printed circuit board; and a second connector of claim 2 having cavities and passages therein arranged in a selected pattern conforming to that of said printed circuit board, said second connector having the cylindrical ends of the contacts of said first connector received in the tuning fork ends of its contacts.

* * * * *